US009895793B2

(12) United States Patent
Shiao

(10) Patent No.: US 9,895,793 B2
(45) Date of Patent: Feb. 20, 2018

(54) SPEED-SELECTABLE HAND TOOL

(71) Applicant: Hsuan-Sen Shiao, Taichung (TW)

(72) Inventor: Hsuan-Sen Shiao, Taichung (TW)

( * ) Notice: Subject to any disclaimer, the term of this patent is extended or adjusted under 35 U.S.C. 154(b) by 276 days.

(21) Appl. No.: 14/967,664

(22) Filed: Dec. 14, 2015

(65) Prior Publication Data

US 2016/0375562 A1 Dec. 29, 2016

(30) Foreign Application Priority Data

Jun. 26, 2015 (TW) ..... 104210350 U

(51) Int. Cl.
*B25B 17/02* (2006.01)
*B25B 15/04* (2006.01)
*B25B 17/00* (2006.01)

(52) U.S. Cl.
CPC ..... *B25B 15/04* (2013.01); *B25B 17/00* (2013.01)

(58) Field of Classification Search
CPC ..... B25B 15/04; B25B 17/00
See application file for complete search history.

(56) References Cited

U.S. PATENT DOCUMENTS 5,406,866 A * 4/1995 Badiali ..... B25B 15/02 81/57.3
6,658,970 B2 * 12/2003 Shiao ..... B25B 13/468 192/43.1
7,353,734 B1 * 4/2008 Hu ..... B25B 15/04 81/62
2010/0018366 A1 * 1/2010 Hu ..... B25B 15/04 81/436
2010/0116097 A1 * 5/2010 Xu ..... B25B 13/463 81/62

* cited by examiner

*Primary Examiner* — David B Thomas
(74) *Attorney, Agent, or Firm* — Trop Pruner & Hu, P.C.

(57) ABSTRACT

A speed-selectable hand tool includes a handle, a cage member fixed to the handle, a shaft member extending into the cage member, a sleeve member sleeved on the shaft member and extending into the cage member, a plurality of transmission members each meshing with the shaft member and the sleeve member, a plurality of pawls mounted to the cage, a knob surrounding the pawls, and an outer casing mounted with the transmission members. The speed-selectable hand tool is operable to serve as a non-ratcheting hand tool or a ratcheting hand tool by rotating the knob relative to the cage member to actuate the pawls. The rotational speed of the shaft member relative to the handle is selectable through operation of the outer casing.

8 Claims, 14 Drawing Sheets

SPEED-SELECTABLE HAND TOOL

CROSS-REFERENCE TO RELATED APPLICATION

This application claims priority of Taiwanese Application No. 104210350, filed on Jun. 26, 2015.

FIELD

The disclosure relates to a hand tool, and more particularly to a speed-selectable hand tool.

BACKGROUND

U.S. Pat. No. 6,658,970 discloses a conventional screwdriver including a shaft-mounting seat, a handle, a ratchet assembly, a drive shaft, two pawls and a tubular sleeve. The shaft-mounting seat is connected fixedly to the handle. The ratchet assembly is connected to the drive shaft, and is disposed in the shaft-mounting seat. The pawls are mounted movably in the shaft-mounting seat, and are operable to engage removably the ratchet assembly. The tubular sleeve is mounted around the shaft-mounting seat, and is operable for switching states of the pawls such that the conventional screwdriver is convertible to serve as a ratcheting screwdriver or a non-ratcheting screwdriver. However, in use, the rotating speed of the drive shaft is the same as that of the handle, so that the conventional screwdriver may be laborious.

As shown in FIGS. 1 and 2, U.S. Pat. No. 5,406,866 discloses a conventional speed-selectable screwdriver 10 including a handle 11, an insert 12, a roller cage 13, a plurality of first rollers 14, a plurality of second rollers 15, a limiting spring 16, a knob 17, a drive shaft 18, an overdrive sleeve 19, two triangular mounting plates 20, three gear assemblies 21, a housing 22, a bit 23 and a bit holder 24. The insert 12 is mounted fixedly in the handle 11, and is formed with a non-circular hole 121. The roller cage 13 is mounted rotatably in the non-circular hole 121, and is formed with a plurality of channels 131. The limiting spring 16 is mounted to the roller cage 13 for limiting the relative movement between the roller cage 13 and the insert 12. The knob 17 is mounted fixedly around a front portion of the roller cage 13. The drive shaft 18 is inserted into the roller cage 13, and has a splined front end 181 and an enlarged body portion 182. The overdrive sleeve 19 is sleeved on the drive shaft 18, is located between the splined from end 181 and the enlarged body portion 182 of the drive shaft 18, and has a sun gear portion 191. The first rollers 14 are mounted respectively and movably in the channels 131 of the roller cage 13, and are contactable with the enlarged body portion 182 of the drive shaft 18. The second rollers 15 are mounted respectively and movably in the channels 131 of the roller cage 13, and are contactable with the overdrive sleeve 19. The mounting plates 20 are mounted rotatably and respectively on the drive shaft 18 and the overdrive sleeve 19. Each of the gear assemblies 21 is mounted rotatably between the mounting plates 20, and has a planetary gear 211 that meshes with the sun gear portion 191 of the overdrive sleeve 19, and an auxiliary gear 212 that is co-rotatable with the planetary gear 211 and that meshes with the splined front end 181 of the drive shaft 18. The housing 22 is mounted fixedly around the mounting plates 20. The bit holder 24 is connected co-rotatably to the drive shaft 18. The bit 23 is mounted co-rotatably to the bit holder 24.

Referring further to FIG. 3, the insert 12 has a plurality of cam surfaces 122 and a plurality of slip surfaces 123. The cam surfaces 122 and the slip surfaces 123 are arranged alternately in the circumferential direction, and cooperatively define the non-circular hole 121.

For each of the gear assemblies 21, the number of teeth of the auxiliary gear 212 is two times the number of teeth of the planetary gear 211, and is the same as that of the sun gear portion 191 of the overdrive sleeve 19. The number of teeth of the planetary gear 211 of each of the gear assemblies 21 is the same as that of the splined front end 181 of the drive shaft 18.

When a user holds firmly the housing 22 and turns the handle 11 relative to the housing 22 in a first rotational direction (D1, see FIG. 3), the cam surfaces 122 of the insert 12 respectively push the second rollers 15 to be in frictional contact with the overdrive sleeve 19, such that the overdrive sleeve 19 is co-rotatable with the handle 11. By virtue of the gear assemblies 21, the drive shaft 18 is rotated in the first rotational direction (D1) at a rotational speed four times the rotational speed of the overdrive sleeve 19. At this time, an outer surrounding surface of the enlarged body portion 182 of the drive shaft 18 pushes the first rollers 14 to correspond respectively in angular position to the slip surfaces 123 so as to permit the relative rotation between the drive shaft 18 and the insert 12.

When the user turns the handle 11 in the first rotational direction (D1) without holding firmly the housing 22, the cam surfaces 122 of the insert 12 respectively push the first rollers 14 to be in frictional contact with the enlarged body portion. 182 of the drive shaft 18, such that the drive shaft 18 is rotated by the handle 11 at the same rotational speed. Additionally, when the user turns the handle 11 in a second rotational direction (D2, see FIG. 3) without holding firmly the housing 22, the slip surfaces 123 are rotated to correspond respectively in angular position to first rollers 14, such that the drive shaft 18 would not be rotated by the handle 11.

However, the conventional speed-selectable screwdriver 10 cannot serve as a non-ratcheting screwdriver, and has a relatively complex structure. Moreover, since the handle 11 rotates the drive shaft 18 by virtue of the frictional contact between each of the first rollers 14 and the enlarged body portion 182 of the drive shaft 18, or the frictional contact between each of the second rollers 15 and the overdrive sleeve 19, an output torque of the drive shaft 18 may be insufficiently large.

SUMMARY

Therefore, an object of the disclosure is to provide a speed-selectable hand tool that can overcome at least one of the aforesaid drawbacks associated with the prior arts.

According to the disclosure, the speed-selectable hand tool includes a handle, a cage member, a shaft member, an overdrive unit, a pawl unit, a knob, an outer casing and a head unit. The cage member has a cage section and a connecting section. The cage section has a front portion, a rear portion that is spaced apart from the front portion along an axis, an intermediate portion that is connected between the front and rear portions, a retaining space that is formed, in the front portion and the intermediate portion and that extends along the axis, four through grooves each of which is formed in the intermediate portion and extends in the radial direction of the axis, and a first shaft hole portion that is formed in the rear portion. The connecting section extends along the axis from one end of the rear portion distal from the from portion, is connected fixedly to the handle, and is formed with a second shaft hole portion that is in spatial communication with the first shaft hole portion. The shaft member extends along the axis, is rotatable relative to the cage member, and has a first ratchet wheel section that is retained in the retaining space, a rod section that extends through the first and second shaft hole portions, and a first gear section that is located at a front side of the first ratchet wheel section opposite to the rod section. The overdrive unit includes a sleeve member that is sleeved rotatably on the shaft member, that is located at the front side of the first ratchet wheel section opposite to the rod section, and that has a second ratchet wheel section retained in the retaining space and proximate to the first ratchet wheel section, and a second gear section distal from the first ratchet wheel section, two spaced-apart and substantially polygonal support frames that are mounted rotatably and respectively on the sleeve member and the shaft member, and a plurality of transmission members each of which is mounted rotatably between the support frames, and has a small gear section meshing with the second gear section of the sleeve member, and a large gear section meshing with the first gear section of the shaft member. The pawl unit includes a mounting plate that is mounted in the front portion of the cage section of the cage member, first and second shaft pawls that are partially retained in the retaining space, and first and second sleeve pawls that are partially retained in the retaining space. The first shaft pawl has a main body that is mounted pivotally between the mounting plate and the rear portion of the cage section of the cage member, an engaging section that extends from the main body, and a driven section that extends from the main body and out of the cage section of the cage member through a corresponding one of the through grooves, and is operable to switch between an enabled state where the engaging section of the first shaft pawl engages separably the first ratchet wheel section of the shaft member for preventing the shaft member from rotating relative to the cage member in a first rotational direction, and a disabled state where the engaging section of the first shaft pawl is separated from the first ratchet wheel section. The second shaft pawl has a main body that is mounted pivotally between the mounting plate and the rear portion of the cage section of the cage member, an engaging section that extends from the main body, and a driven section that extends from the main body and out of the cage section of the cage member through a corresponding one of the through grooves, and is operable to switch between an enabled state where the engaging section of the second shaft pawl engages separably the first ratchet wheel section of the shaft member for preventing the shaft member from rotating relative to the cage member in a second rotational direction opposite to the first rotational direction, and a disabled state where the engaging section of the second shaft pawl is separated from the first ratchet wheel section. The first sleeve pawl has a main body that is mounted pivotally between the mounting plate and the rear portion of the cage section of the cage member, an engaging section that extends from the main body, and a driven section that extends from the main body and out of the cage section of the cage member through a corresponding one of the through grooves, and is operable to switch between an enabled state where the engaging section of the first sleeve pawl engages separably the second ratchet wheel section of the sleeve member for preventing the sleeve member from rotating relative to the cage member in the first rotational direction, and a disabled state where the engaging section of the first sleeve pawl is separated from the second ratchet wheel section. The second sleeve pawl has a main body that is mounted pivotally between the mounting plate and the rear portion of the cage section of the cage member, an engaging section that extends from the main body, and a driven section that extends from the main body and out of the cage section of the cage member through a corresponding one of the through grooves, and is operable to switch between an enabled state where the engaging section of the second sleeve pawl engages separably the second ratchet wheel section of the sleeve member for preventing the sleeve member from rotating relative to the cage member in the second rotational direction, and a disabled state where the engaging section of the second sleeve pawl is separated from the second ratchet wheel section. The knob is mounted rotatably around the cage section of the cage member and the pawl unit, and has a surrounding wall that surrounds the pawl unit, a base wall that is dispose at an end of the surrounding wall distal from the handle, two first driving protrusions that are formed on an inner surface of the surrounding wall for respectively driving the driven sections of the first and second shaft pawls so as to switch the states of the first and second shaft pawls, and two second driving protrusions that are formed on the inner surface of the surrounding wall for respectively driving the driven sections of the first and second sleeve pawls so as to switch the states of the first and second sleeve pawls. The first driving protrusions and the second driving protrusions are angularly spaced apart from each other about the axis. The outer casing is formed with a substantially polygonal hole for retaining co-rotatably the support frames therein. The head unit is connected to and driven by the shaft member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
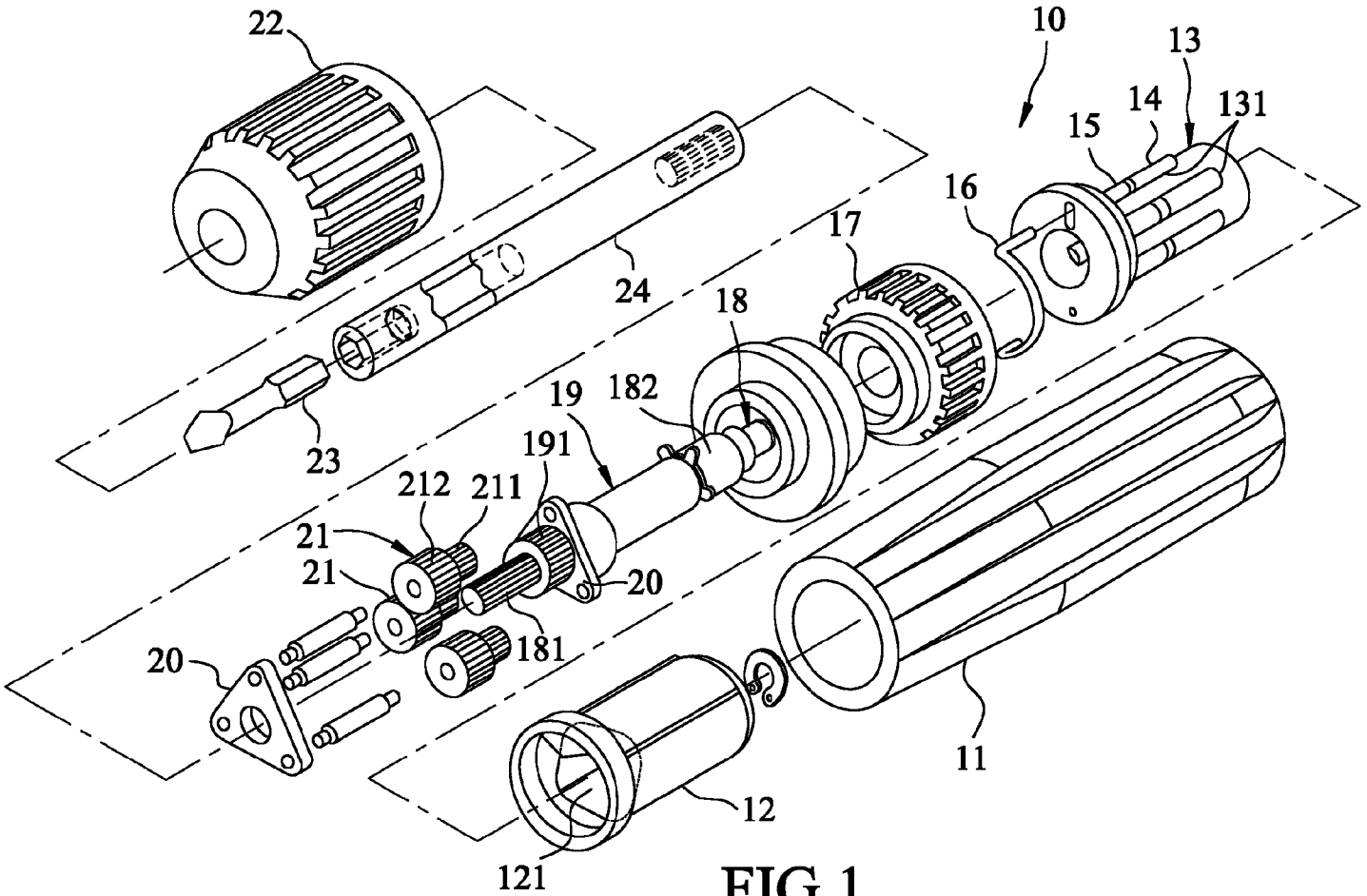
FIG.1 PRIOR ART
FIG. 1 is an exploded, perspective view of conventional speed-selectable screwdriver disclosed in U.S. Pat. No. 5,406,866.
Figure 2:
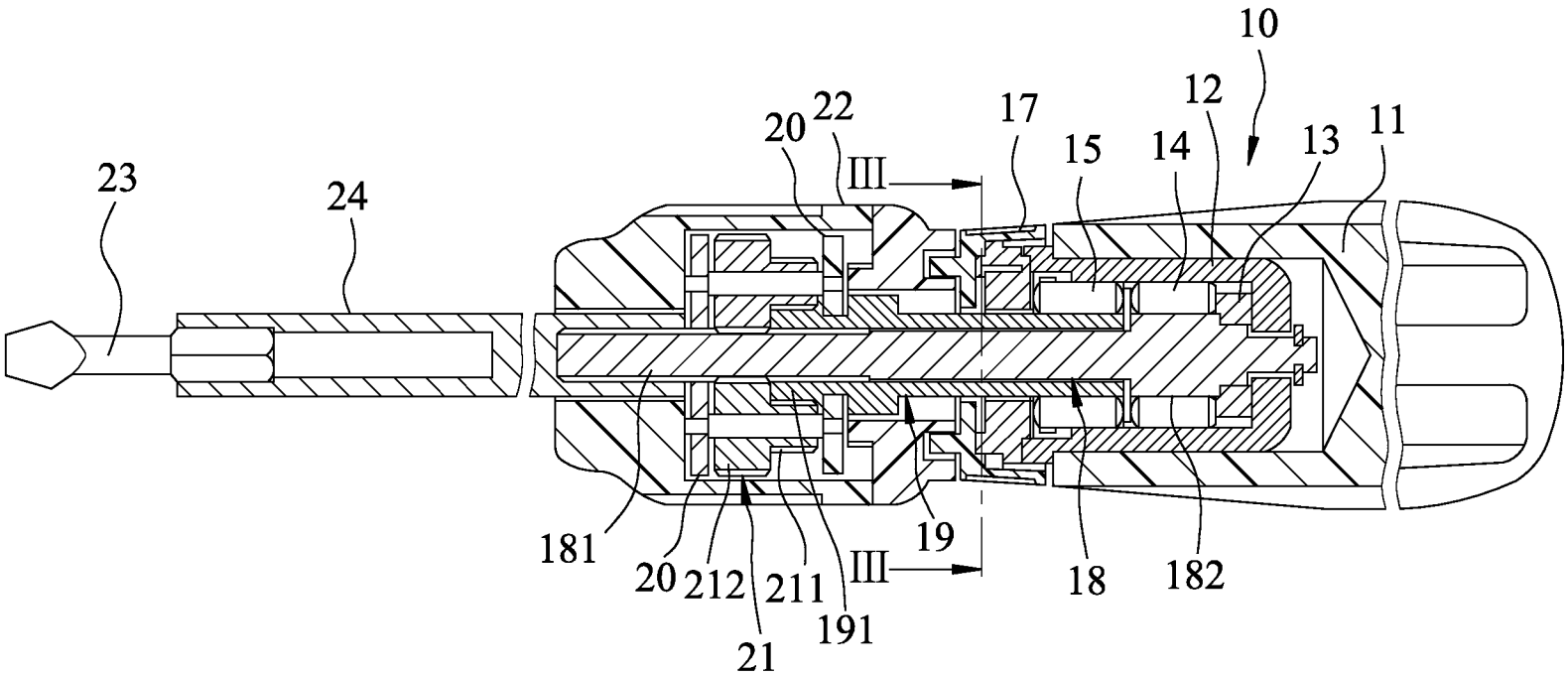
FIG.2 PRIOR ART
FIG. 2 is a sectional view of the conventional speed-selectable screwdriver.
Figure 3:
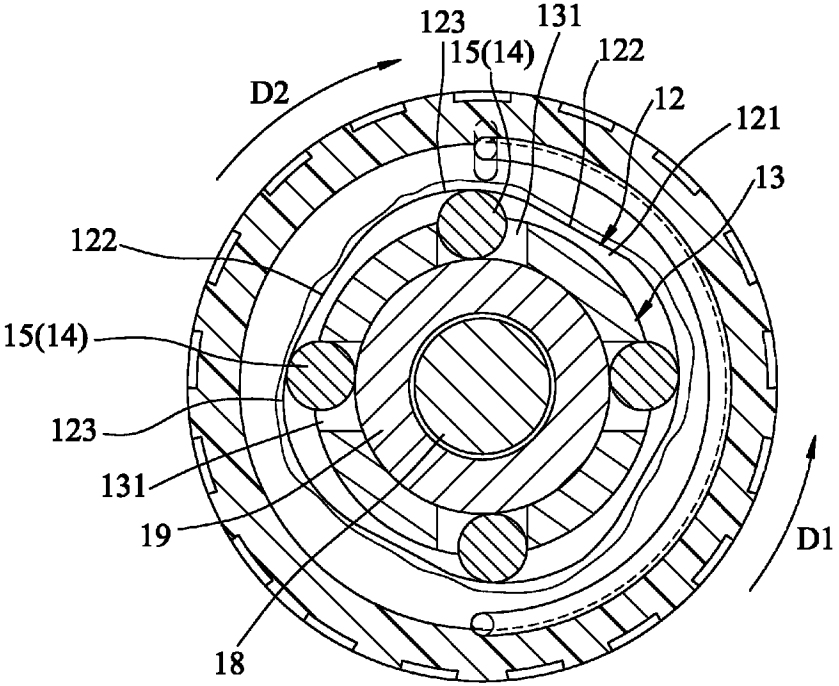
FIG.3 PRIOR ART
FIG. 3 is a sectional view of the conventional speed-selectable screwdriver taken along line III-III in FIG. 2.
Figure 4:
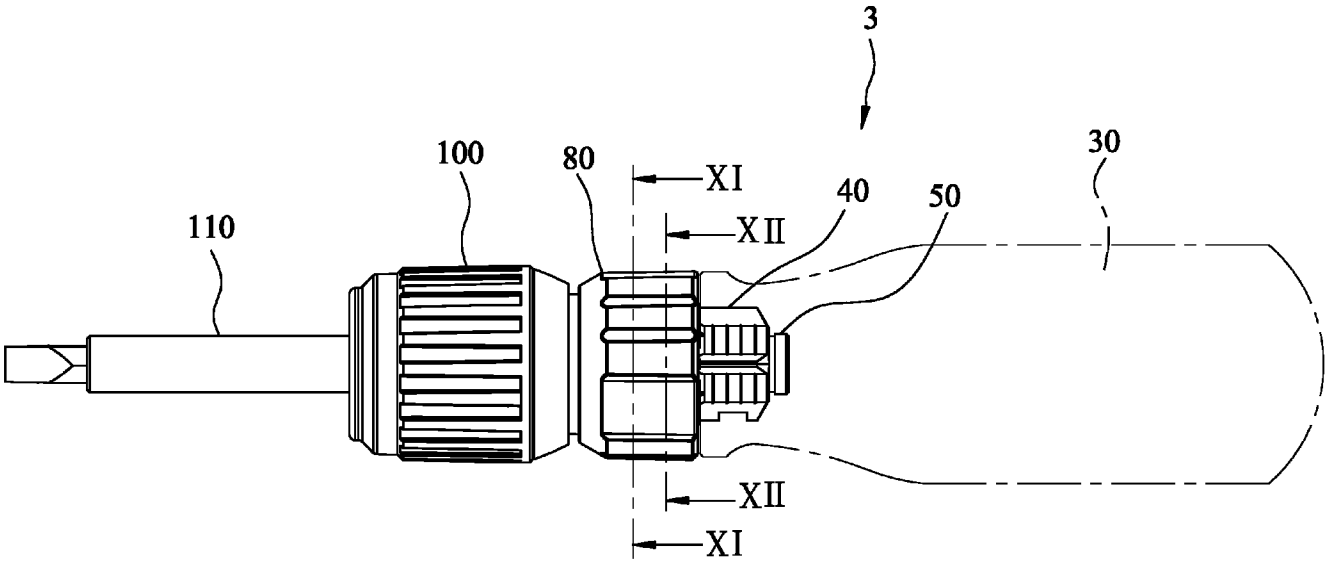
FIG. 4 is a schematic side view of an embodiment of a speed-selectable hand tool according to the disclosure.
Figure 5:
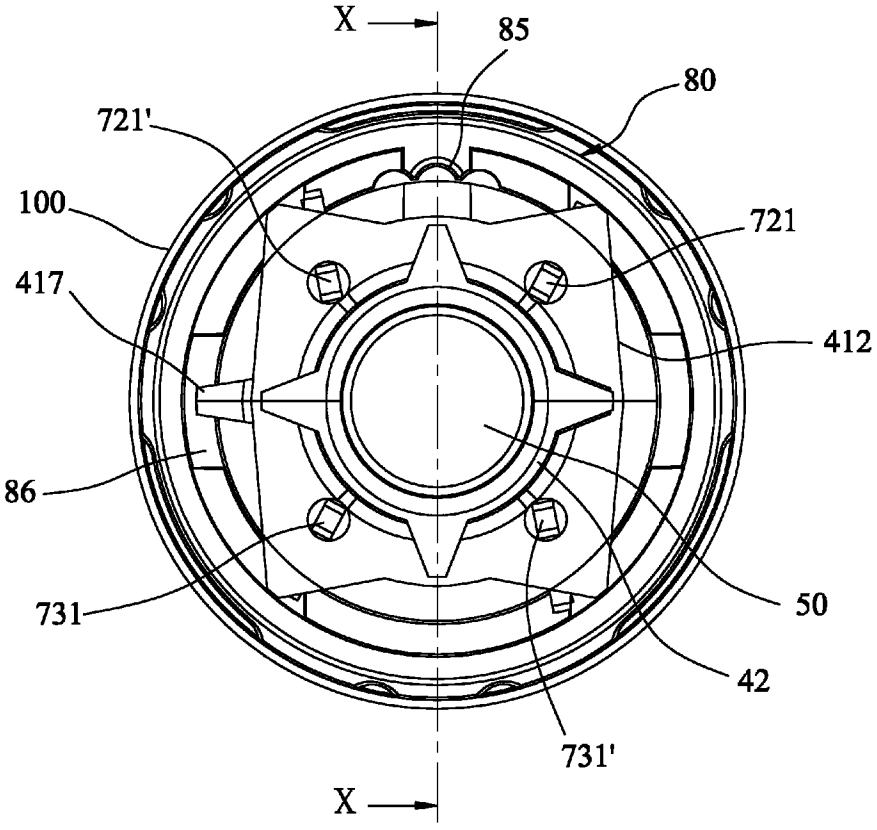
FIG. 5 is a rear view of the embodiment omitting a handle.

Referring to FIGS. 4 to 10, an embodiment of a speed-selectable hand tool 3 according to the disclosure includes a handle 30, a cage member 40, a shaft member 50, an overdrive unit 60, a pawl unit 70, a knob 80, a positioning unit 90, an outer casing 100 and a head unit 110.

Figure 8:
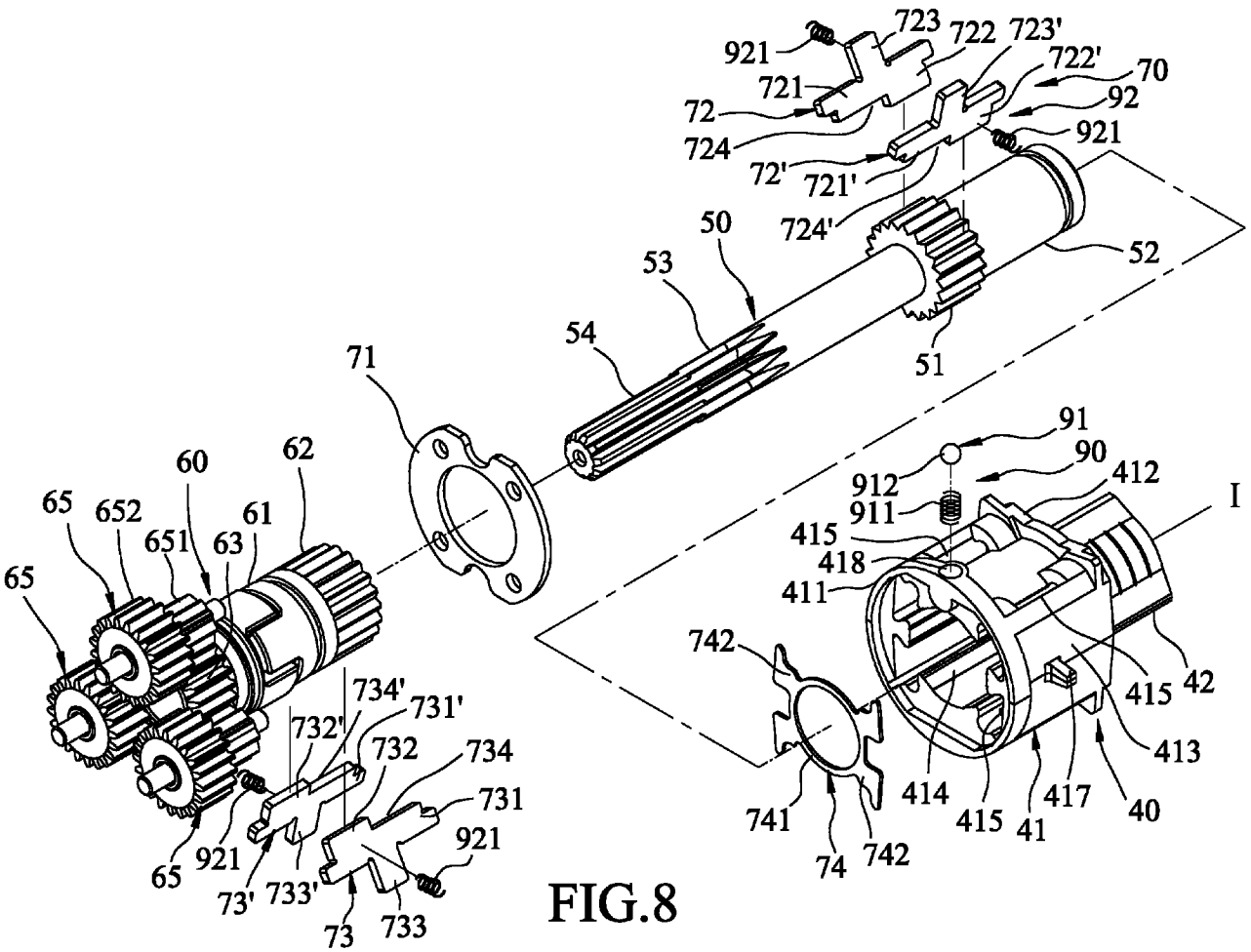
FIG. 8 is still another fragmentary, partly exploded perspective view of the embodiment.
Figure 9:
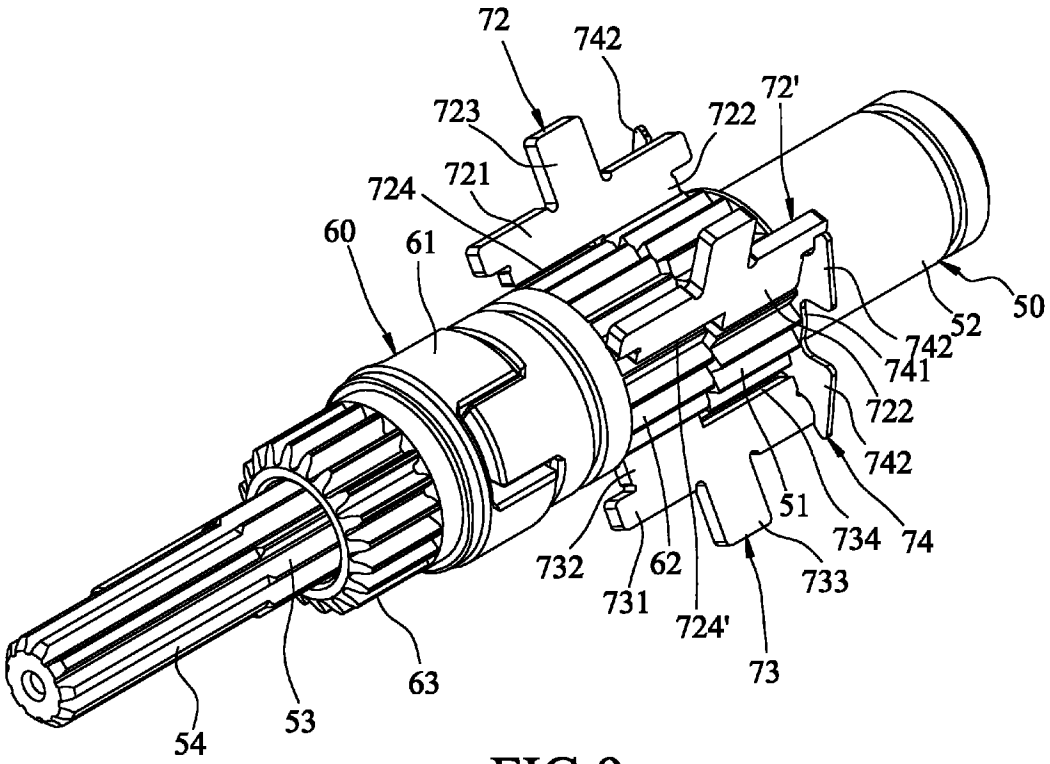
FIG. 9 is a fragmentary assembled perspective view of a portion of the embodiment.

With particular reference to FIG. 8, the cage member 40 has a cage section 41 and a connecting section 42. The cage section 41 has a front portion 411, a rear portion 412 that is spaced apart from the front portion 411 along an axis (I), an intermediate portion 413 that is connected between the front and rear portions 411, 412, a retaining space 414 that is formed in the front portion 411 and the intermediate portion 413 and that extends along the axis (I), four through grooves 415 each of which is formed in the intermediate portion 413 and extends in the radial direction of the axis (I), a first shaft hole portion. 416 (see FIG. 10) that is formed in the rear portion 412, a limiting block 417 that projects outwardly from an outer surface of the intermediate portion 413, and an installation hole 418 that is formed in the front portion 411 and that extends in the radial direction of the axis (I). The installation hole 418 is configured as a blind hole. The connecting section 42 extends along the axis (I) from one end of the rear portion 412 distal from the front portion 411, is connected fixedly to the handle 30, and is formed with a second shaft hole portion 421 (see FIG. 10) that is in spatial communication with the first shaft hole portion 416.

The shaft member 50 extends along the axis (I), is rotatable relative to the cage member 40, and has a first ratchet wheel section 51 that is retained in the retaining space 414, a rod section 52 that extends through the first and second shaft hole portions 416, 421, and a first gear section 53 that is located at a front side of the first ratchet wheel section 51 opposite to the rod section 52, and a splined section 54 that is located at a front side of the first gear section 53 opposite to the first ratchet wheel section 51.

The overdrive unit 60 includes a sleeve member 61 that is sleeved rotatably on the shaft member 50, that is located at the front side of the first ratchet wheel section 51 opposite to the rod section 52, and that has a second ratchet wheel section 62 retained in the retaining space 414 and proximate to the first ratchet wheel section 51, and a second gear section 63 distal from the thirst ratchet wheel section 51 such that the second ratchet wheel section 62 is between the second gear section 63 and the first ratchet wheel section 51, two spaced-apart polygonal support frames 64 that are mounted rotatably and respectively on the sleeve member 61 and the shaft member 50, and a plurality of transmission members 65 each of which is mounted rotatably between the support frames 64, and has a small gear section 651 meshing with the second gear section 63 of the sleeve member 61, and a large gear section 652 meshing with the first gear section 53 of the shaft member 50. The second gear section 63 of the sleeve member 61 and the large gear section 652 of each of the transmission members 65 have the same number of teeth. The first gear section 53 of the shaft member 50 and the small gear section 651 of each of the transmission members 65 have the same number of teeth. In this embodiment, the number of teeth of the large gear section 652 of each of the transmission members 65 is two times that of the small gear section 651 of the transmission member 65, such that when the sleeve member 61 rotates relative to the support frames 64, the shaft member 50 is driven to rotate relative to the support frames 64 at a speed four times that of the sleeve member 61 via the transmission members 65. Further note that, in this embodiment, the sleeve member 61 is not a one-piece element, but is an assembly of two components (see FIGS. 8 to 10).

In this embodiment, each of the support frames 64 is triangular-shaped, and the overdrive unit 60 includes three transmission members 65.

Figure 10:
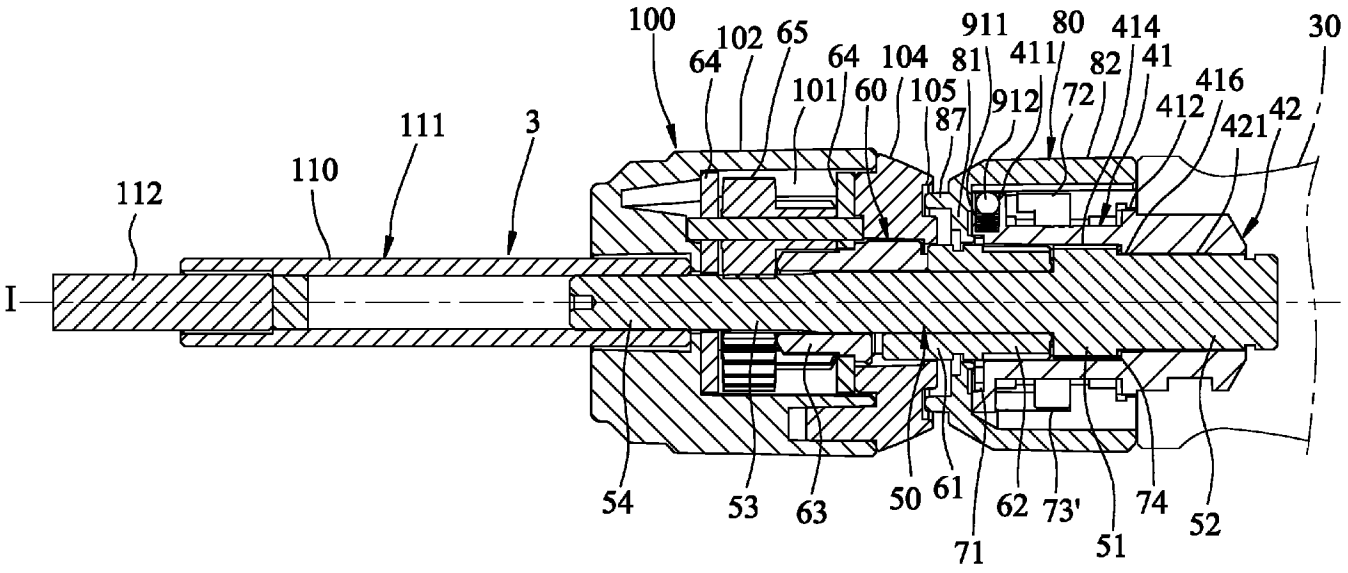
FIG. 10 is a schematic fragmentary sectional view of the embodiment taken along line X-X in FIG. 5.
Figure 11:
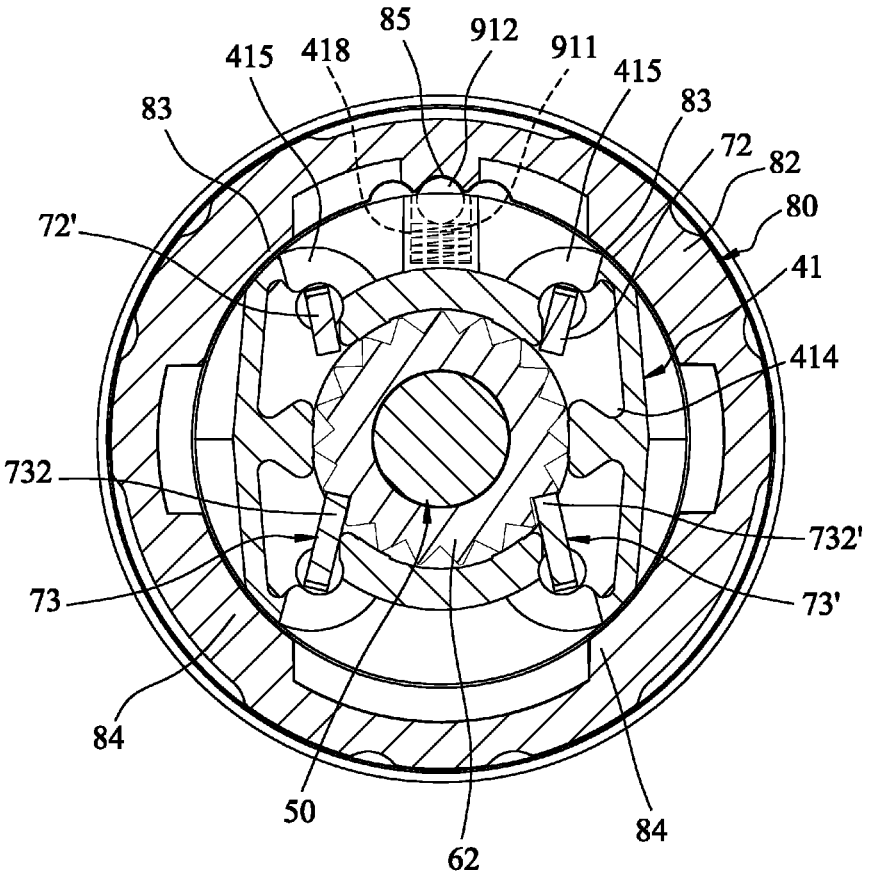
FIG. 11 is a schematic sectional view of the embodiment taken along line XI-XI in FIG. 4.
Figure 12:
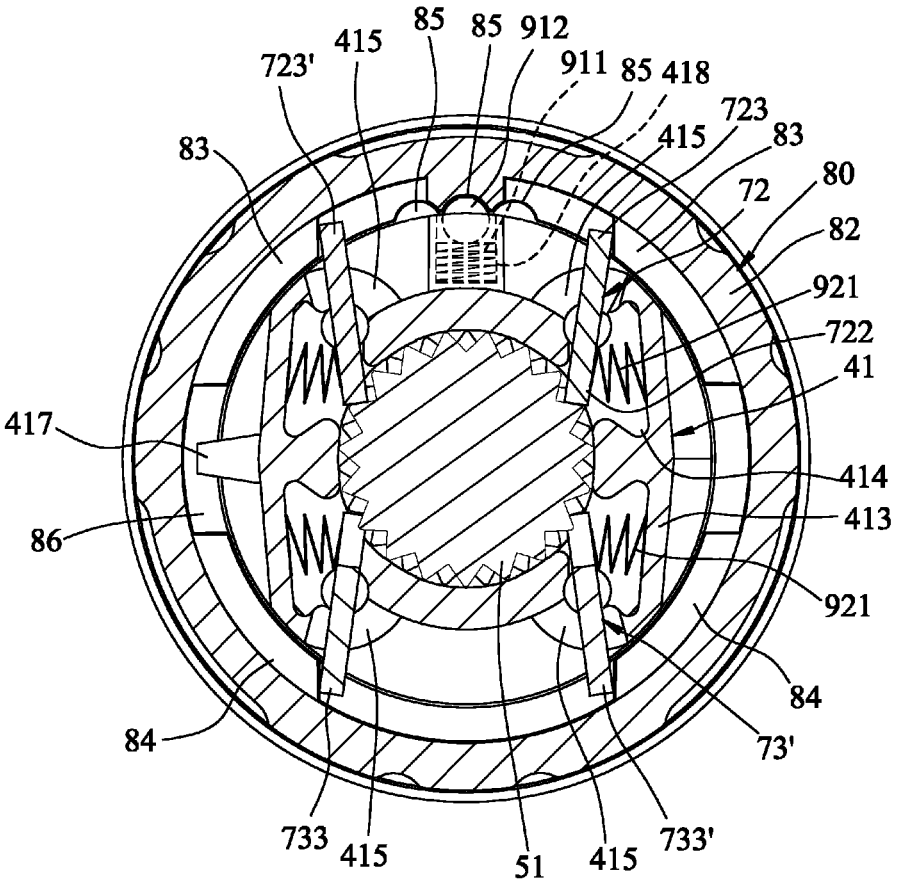
FIG. 12 is another schematic sectional view of the embodiment taken along line XII-XII in FIG. 4.

With particular reference to FIGS. 8 and 10, the pawl unit 70 includes a mounting plate 71 that is mounted in the front portion 411 of the cage section 41 of the cage member 40, first and second shaft pawls 72, 72' that are partially retained in the retaining space 414, first and second sleeve pawls 73, 73' that are partially retained in the retaining space 414, and an abrasion-resistant plate 74 that is retained in the retaining space 414.

The first shaft pawl 72 has a main body 721 that is mounted pivotally between the mounting plate 71 and the rear portion 412 of the cage section 41 of the cage member 40, an engaging section 722 that extends from the main body 721, and a driven section 723 that extends from the main body 721 and out of the cage section 41 of the cage member 40 through one of the through grooves 415, and is operable to switch between an enabled state where the engaging section 722 engages separably the first ratchet wheel section 51 of the shaft member 50 for preventing the shaft member 50 from rotating relative to the cage member 40 in a first rotational direction (R1, see FIG. 13), and a disabled state where the engaging section. 722 is separated from the first ratchet wheel section 51. The first shaft pawl 72 further has a recess 724 that corresponds in position to the second ratchet wheel section 62 of the sleeve member 61 such that the first shaft pawl 72 is prevented from engaging the second ratchet wheel section 62 of the sleeve member 61.

The second shaft pawl 72' has a main body 721' that is mounted pivotally between the mounting plate 71 and the rear portion 412 of the cage section 41 of the cage member 40, an engaging section 722' that extends from the main body 721', and a driven section 723' that extends from the main body 721' and out of the cage section 41 of the cage member 40 through one of the through grooves 415, and is operable to switch between an enabled state where the engaging section 722' engages separably the first ratchet wheel section 51 of the shaft member 50 for preventing the shaft member 50 from rotating relative to the cage member 40 in a second rotational direction (R2, see FIG. 14) opposite to the first rotational direction (R1), and a disabled state where the engaging section 722' is separated from the first ratchet wheel section 51. The second shaft pawl 72' further has a recess 724' that corresponds in position to the second ratchet wheel section 62 of the sleeve member 61 such that the second shaft pawl 72' is prevented from engaging the second ratchet wheel section 62 of the sleeve member 61.

The first sleeve pawl 73 has a main body 731 that is mounted pivotally between the mounting plate 71 and the rear portion 412 of the cage section 41 of the cage member 40, an engaging section 732 that extends from the main body 731, and a driven section 733 that extends from the main body 731 and out of the cage section 41 of the cage member 40 through one of the through grooves 415, and is operable to switch between an enabled state where the engaging section 732 engages separably the second ratchet wheel section 62 of the sleeve member 61 for preventing the sleeve member 61 from rotating relative to the cage member 40 in the first rotational direction (R1), and a disabled state where the engaging section 732 is separated from the second ratchet wheel section 62. The first sleeve pawl 73 further has a recess 734 that corresponds in position to the first ratchet wheel section 51 of the shaft member 50 such that the first sleeve pawl 73 is prevented from engaging the first ratchet wheel section 51 of the shaft member 50.

The second sleeve pawl 73' has a main body 731' that is mounted pivotally between the mounting plate 71 and the rear portion 412 of the cage section 41 of the cage member 40, an engaging section 732' that extends from the main body 731', and a driven section 733' that extends from the main body 731' and out of the cage section 41 of the cage member 40 through one of the through grooves 415, and is operable to switch between an enabled state where the engaging section 732' engages separably the second ratchet wheel section 62 of the sleeve member 61 for preventing the sleeve member 61 from rotating relative to the cage member 40 in the second rotational direction (R2), and a disabled state where the engaging section 732' is separated from the second ratchet wheel section 62. The second sleeve pawl 73' further has a recess 734' that corresponds in position to the first ratchet wheel section 51 of the shaft member 50 such that the second sleeve pawl 73' is prevented from engaging the first ratchet wheel section 51 of the shaft member 50.

In this embodiment, each of the driven sections 723, 723', 733, 733' of the first and second shaft pawls 72, 72' and the first and second sleeve pawls 73, 73' extends out of the cage section 41 of the cage member 40 through a respective one of the through grooves 415.

The abrasion-resistant plate 74 is disposed adjacent to the rear portion 412, and has a ring section 741 that surrounds the rod section 52 of the shaft member 50, and four position arms 742 that extend from the ring section 741. The abrasion-resistant plate 74 is for alleviating the abrasion of the cage member 40 due to the relative rotation between the shaft member 50 and the cage member 40.

Referring to FIGS. 4, 7, 10 and 12, the knob 80 is mounted rotatably around the cage section 41 of the cage member 40 and the pawl unit 70, and has a surrounding wall 82 that surrounds the pawl unit 70, a base wall 81 that is dispose at an end of the surrounding wall 82 distal from the handle 30, two first driving protrusions 83 that are formed on an inner surface of the surrounding wall 82 for respectively driving the driven sections 723, 723' of the first and second shaft pawls 72, 72' so as to switch the states of the first and second shaft pawls 72, 72', and two second driving protrusions 84 that are formed on the inner surface of the surrounding wall 82 for respectively driving the driven sections 733, 733' of the first and second sleeve pawls 73, 73' so as to switch the states of the first and second sleeve pawls 73, 73'. The first driving protrusions 83 and the second driving protrusions 84 are angularly spaced apart from each other about the axis (I). The first driving protrusions 83 are adjacent to each other. The second driving protrusions 84 are adjacent to each other. The knob 80 further has three positioning grooves 85 that are formed in the inner surface of the surrounding wall 82 and that are located between the first driving protrusions 83, and a limiting space 86 (see FIG. 12) that is defined between one of the first driving protrusions 83 and one of the second driving protrusions 84 for extension of the limiting block 417 of the cage member 40 so as to limit the range of relative rotational movement between the cage member 40 and the knob 80. The positioning grooves 85 are arranged in a circumferential direction of the knob 80. The knob 80 further has an annular wall 87 (see FIG. 10) that extends from the base wall 81 away from the surrounding wall 82.

The positioning unit 90 includes a positioning set 91 and a spring set 92. The positioning set 91 includes a resilient member 911 that is retained in the installation hole 418, and a positioning ball member 912 that is biased resiliently by the resilient member 911 to engage an alternative one of the positioning grooves 82 so as to position the knob 80 relative to the cage member 40. The spring set 92 includes four pawl springs 921 each of which is disposed between an inner surface of the intermediate portion 413 of the cage member 40 and the engaging section. 722, 722', 732, 732' of a respective one of the first and second shaft pawl s 72, 72' and the first and second sleeve pawls 73, 73' for retaining the corresponding one of the first and second shaft pawls 72, 72' and the first and second sleeve pawls 73, 73' at the enabled state. In this embodiment, each of the resilient member 911 and the pawl springs 921 is configured as a compression spring.

Figure 6:
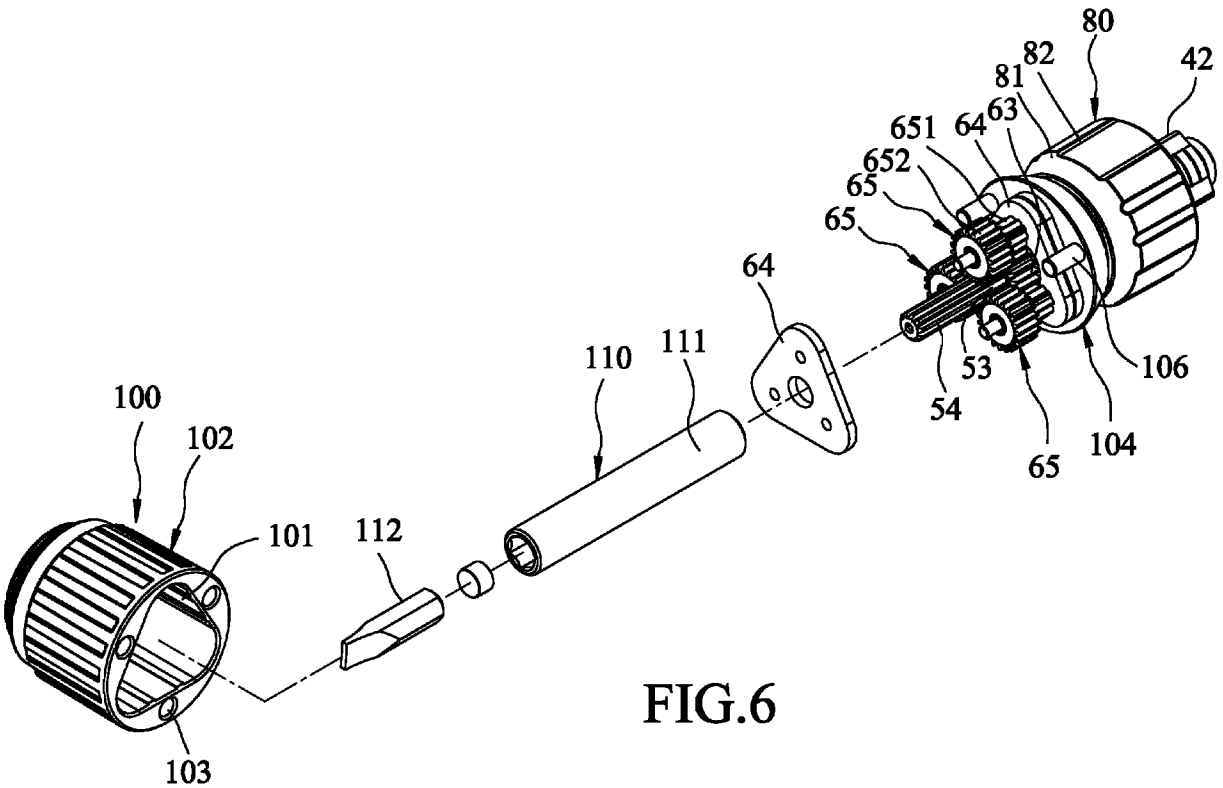
FIG. 6 is a fragmentary, partly exploded perspective view of the embodiment.
Figure 7:
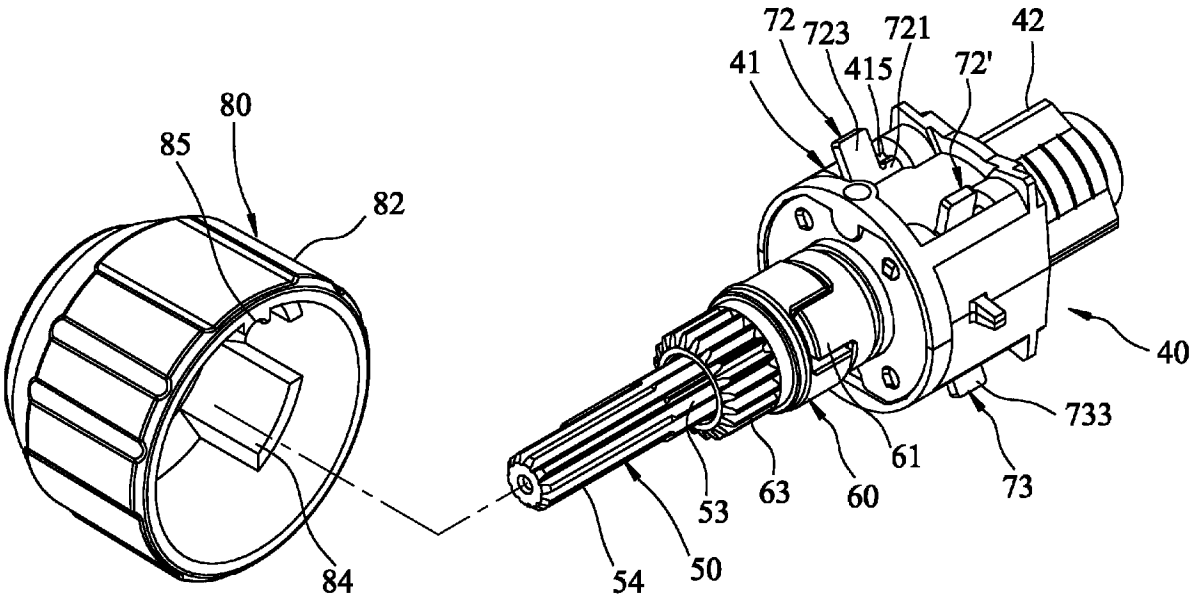
FIG. 7 is another fragmentary, partly exploded perspective view of the embodiment.

Referring to FIGS. 6 and 10, the outer casing 100 is formed with a polygonal hole 101 for retaining co-rotatably the support frames 64. In this embodiment, the outer casing 100 includes interconnected front and rear casing parts 102, 104. The from casing part 102 is formed with the polygonal hole 101 and three insertion holes 103. The polygonal hole 101 and the insertion holes 103 open toward the rear casing part 104. The rear casing part 104 is mounted rotatably around the sleeve member 61, is located at one side of the knob 80 opposite to the handle 30, and has three insertion rods 106 that are respectively inserted into the insertion holes 103, and an annular groove 105 (see FIG. 10) that opens toward the knob 80 for retaining the annular wall 87 of the knob 60 therein.

The head unit 110 is connected to and driven by the shaft member 50, and includes a connecting tube 111 that is connected co-rotatably to the splined section 54 of the shaft member 50, and a bit 112 that is connected co-rotatably and detachably to the connecting tube 111 for tightening or loosening a fastener (not shown).

Referring to FIGS. 4, 10, 11 and 12, when the positioning ball member 912 engages the middle one of the positioning grooves 85 (see FIGS. 11 and 12), the speed-selectable hand tool 3 of this disclosure serves as a non-ratcheting screwdriver. Each of the first and second shaft pawls 72, 72' and the first and second sleeve pawls 73, 73' is in the enabled state, such that the shaft member 50 is prevented from rotating relative to the cage member 40 and that the sleeve member 61 is prevented from rotating relative to the cage member 40. As a result, rotation of the handle 30 drives synchronous rotation of the shaft member 50 via the cage member 40 and the first and second shaft pawls 72, 72'. It is noted that, at this time, each of the driven sections 723, 723' of the first and second shaft pawls 72, 72' abuts against the corresponding one of the first driving protrusions 83, each of the driven sections 733, 733' of the first and second sleeve pawls 73, 73' abuts against the corresponding one of the second driving protrusions 84, and the limiting block 417 of the cage member 40 is located at a middle portion of the limiting space 86.

Figure 13:
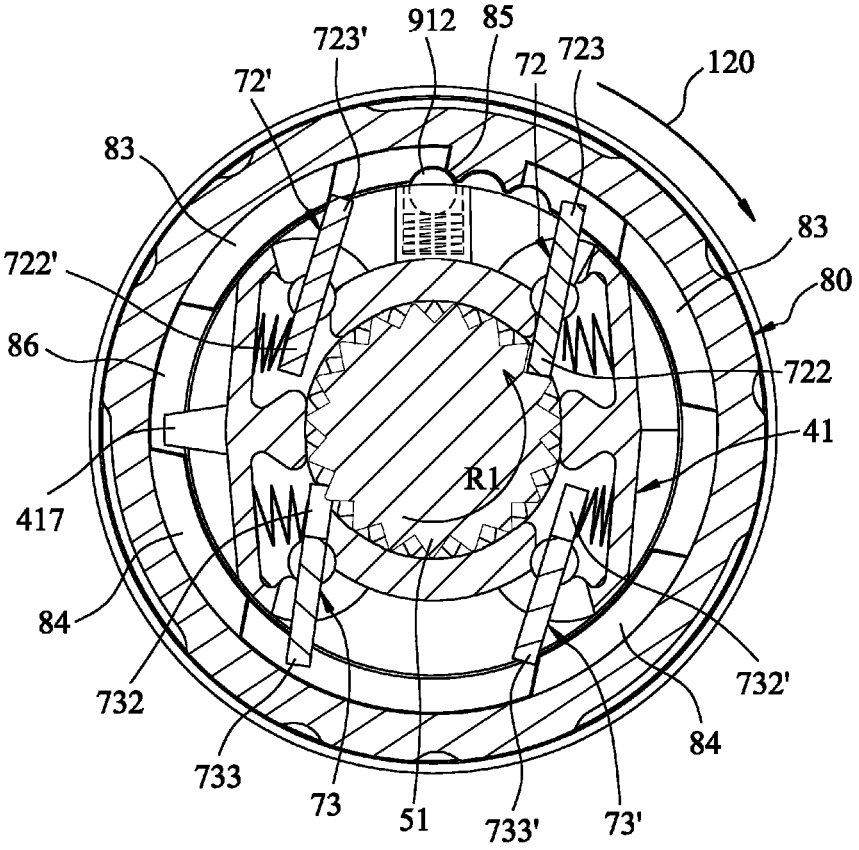
FIG. 13 is still another schematic sectional view of the embodiment similar to FIG. 12.

Referring further to FIG. 13, when the knob 80 is rotated relative to the cage member 40 in a first operating direction 120 to engage the left one of the positioning grooves 85 with the positioning ball member 912, the speed-selectable hand tool 3 of this disclosure serves as a ratcheting screwdriver. The driven section 723' of the second shaft pawl 72' is pushed by the corresponding one of the first driving protrusions 83 such that the second shaft pawl 72' is switched into the disabled state. The driven section 733' of the second sleeve pawl 73' is pushed by the corresponding one of the second driving protrusions 84 such that the second sleeve pawl 73' is switched into the disabled state. The driven section 723 of the first shaft pawl 72 is separated from the corresponding one of the first driving protrusions 83, and the first shaft pawl 72 is retained in the enabled state. The driven section 733 of the first sleeve pawl 73 is separated from the corresponding one of the second driving protrusions 84, and the first sleeve pawl 73 is retained in the enabled state. When a user rotates the handle 30 in the first operating direction 120 without holding the outer casing 100, the shaft member 50 is rotated in the first operating direction 120 at a rotational speed the same as that of the handle 30 via the cage member 40 and the first shaft pawl 72. When the user holds firmly the outer casing 100 and rotates the handle 30 relative to the outer casing 100 in the first operating direction 120, the sleeve member 61 is rotated in the first operating direction 120 at a rotational speed the same as that of the handle 30 via the cage member 40 and the first sleeve pawl 73. Since the support frames 64 are fixed in the outer casing 100, the rotation of the sleeve member 61 drives the shaft member 50 to rotate in the first operating direction 120 at a rotational speed four times that of the sleeve member 61 via the transmission members 65. As a result, the shaft member 50 is rotated at a rotational speed four times that of the handle 30 in the direction the same as that of the handle 30. It is noted that, at this time, the engaging section 722 of the first shaft pawl 72 is pushed outwardly by the first ratchet wheel section 51 of the shaft member 50, and slides on the first ratchet wheel section 51. When the user rotates the handle 30 in a direction opposite to the first operating direction 120, the engaging section 722 of the first shaft pawl 72 would be pushed outwardly by the first ratchet wheel section 51 of the shaft member 50 to slides around the first ratchet wheel section 51. As a result, rotation of the handle 30 in the direction opposite to the first operating direction 120 may not drive rotation of the shaft member 50.

Figure 14:
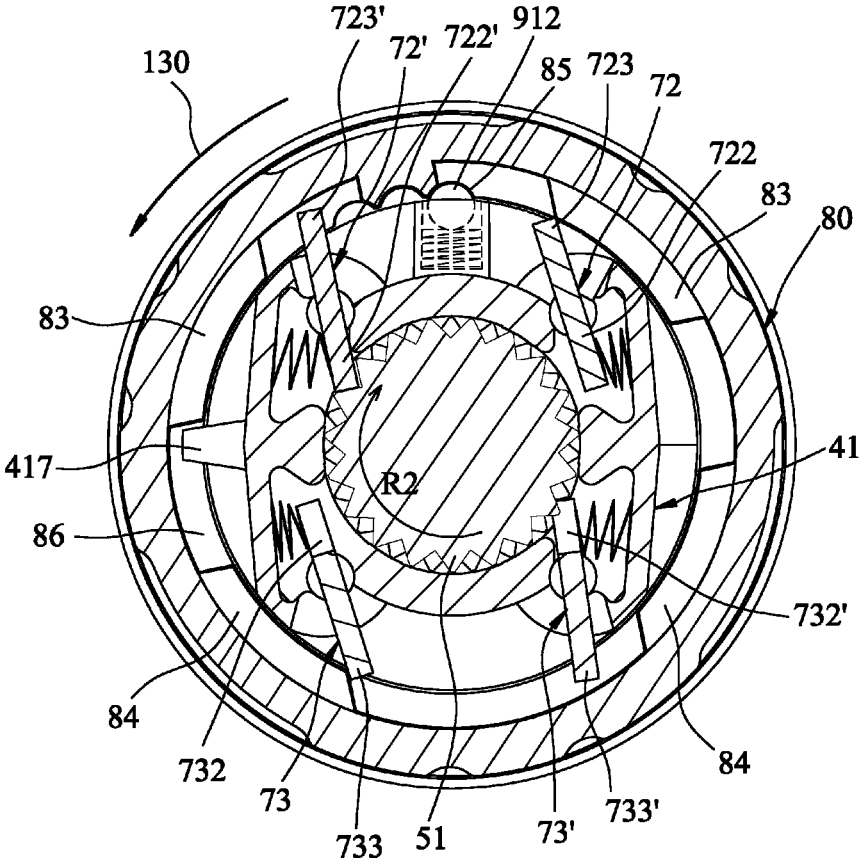
FIG. 14 is still another schematic sectional view of the embodiment similar to FIG. 12.

Referring further to FIG. 14, when the knob 80 is rotated relative to the cage member 40 in a second operating direction 130 to engage the right one of the positioning grooves 85 with the positioning ball member 912, the speed-selectable hand tool 3 of this disclosure serves as a ratcheting screwdriver as well. The driven section 723 of the first shaft pawl 72 is pushed by the corresponding one of the first driving protrusions 83 such that the first shaft pawl 72 is switched into the disabled state. The driven section 733 of the first sleeve pawl 73 is pushed by the corresponding one of the second driving protrusions 84 such that the first sleeve pawl 73 is switched into the disabled state. The driven section 723' of the second shaft pawl 72' is separated from the corresponding one of the first driving protrusions 83, and the second shaft pawl 72' is retained in the enabled state. The driven section 733' of the second sleeve pawl 73' is separated from corresponding one of the second driving protrusions 84, and the second sleeve pawl 73' is retained in the enabled state. Similarly, when the user rotates the handle 30 in the second operating direction 130 without holding the outer casing 100, the shaft member 50 is rotated in the second operating direction 130 at a rotational speed the same as that of the handle 30 via the cage member 40 and the second shaft pawl 72'. When the user holds firmly the outer casing 100 and rotates the handle 30 relative to the outer casing 100 in the second operating direction 130, the shaft member 50 is driven to rotate in the second operating direction 130 at a rotational speed four times that of the handle 30 via the cage member 40, the second sleeve pawl 73', the sleeve member 61 and the transmission members 65. When the user rotates the handle 30 in a direction opposite to the second operating direction 130, the shaft member 50 may not be driven to rotate.

The advantages of the speed-selectable hand tool 3 of this disclosure are as follows.

1. The speed-selectable hand tool 3 is operable to serve as a non-ratcheting hand tool or a ratcheting hand tool.

2. When the speed-selectable hand tool 3 serves as a ratcheting hand tool, the rotational speed of the shaft member 50 is selectable to be the same as or four times that of the handle 30 through operation of the outer casing 100.

3. The handle 30 drives rotation of the shaft member 50 by geometric engagement rather than by frictional contact, so that an output torque of the shaft member 50 can be relatively large.

4. The structure of the speed-selectable hand tool 3 of this disclosure is simpler than that of the conventional speed-selectable screwdriver 10 (FIG. 1) of U.S. Pat. No. 5,406,866.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A speed-selectable hand tool comprising:

a handle;

a cage member having a cage section and a connecting section, said cage section having a front portion, a rear portion that is spaced apart from said front portion along an axis, an intermediate portion that is connected between said front and rear portions, a retaining space that is formed in said front portion and said intermediate portion and that extends along the axis, four through grooves each of which is formed in said intermediate portion and extends in the radial direction of the axis, and a first shaft hole portion that is formed in said rear portion, said connecting section extending along the axis from one end of said rear portion distal from said front portion, being connected fixedly to said handle, and being formed with a second shaft hole portion that is in spatial communication with said first shaft hole portion;

a shaft member extending along the axis, being rotatable relative to said cage member, and having a first ratchet wheel section that is retained in said retaining space, a rod section that extends through said first and second shaft hole portions, and a first gear section that is located at a front side of said first ratchet wheel section opposite to said rod section;

an overdrive unit including a sleeve member that is sleeved rotatably on said shaft member, that is located at the front side of said first ratchet wheel section opposite to said rod section, and that has a second ratchet wheel section retained in said retaining space and proximate to said first ratchet wheel section, and a second gear section distal from said first ratchet wheel section, two spaced-apart and substantially polygonal support frames that are mounted rotatably and respectively on said sleeve member and said shaft member, and a plurality of transmission members each of which is mounted rotatably between said support frames, and has a small gear section meshing with said second gear section of said sleeve member, and a large gear section meshing with said first gear section of said shaft member;

a pawl unit including a mounting plate that is mounted in said front portion of said cage section of said cage member, first and second shaft pawls that are partially retained in said retaining space, and first and second sleeve pawls that are partially retained in said retaining space, said first shaft pawl having a main body that is mounted pivotally between said mounting plate and said rear portion of said cage section of said cage member, an engaging section that extends from said main body, and a driven section that extends from said main body and out of said cage section of said cage member through a corresponding one of said through grooves, and being operable to switch between an enabled state where said engaging section of said first shaft pawl engages separably said first ratchet wheel section of said shaft member for preventing said shaft member from rotating relative to said cage member in a first rotational direction, and a disabled state where said engaging section of said first shaft pawl is separated from said first ratchet wheel section, said second shaft pawl having a main body that is mounted pivotally between said mounting plate and said rear portion of said cage section of said cage member, an engaging section that extends from said main body, and a driven section that extends from said main body and out of said cage section of said cage member through a corresponding one of said through grooves, and being operable to switch between an enabled state where said engaging section of said second shaft pawl engages separably said first ratchet wheel section of said shaft member for preventing said shaft member from rotating relative to said cage member in a second rotational direction opposite to the first rotational direction, and a disabled state where said engaging section of said second shaft pawl is separated from said first ratchet wheel section, said first sleeve pawl having a main body that is mounted pivotally between said mounting plate and said rear portion of said cage section of said cage member, an engaging section that extends from said main body, and a driven section that extends from said main body and out of said cage section of said cage member through a corresponding one of said through grooves, and being operable to switch between an enabled state where said engaging section of said first sleeve pawl engages separably said second ratchet wheel section of said sleeve member for preventing said sleeve member from rotating relative to said cage member in the first rotational direction, and a disabled state where said engaging section of said first sleeve pawl is separated from said second ratchet wheel section, said second sleeve pawl having a main body that is mounted pivotally between said mounting plate and said rear portion of said cage section of said cage member, an engaging section that extends from said main body, and a driven section that extends from said main body and out of said cage section of said cage member through a corresponding one of said through grooves, and being operable to switch between an enabled state where said engaging section of said second sleeve pawl engages separably said second ratchet wheel section of said sleeve member for preventing said sleeve member from rotating relative to said cage member in the second rotational direction, and a disabled state where said engaging section of said second sleeve pawl is separated from said second ratchet wheel section;

a knob mounted rotatably around said cage section of said cage member and said pawl unit, and having a surrounding wall that surrounds said pawl unit, a base wall that is dispose at an end of said surrounding wall distal from said handle, two first driving protrusions that are formed on an inner surface of said surrounding wall for respectively driving said driven sections of said first and second shaft pawls so as to switch the states of said first and second shaft pawls, and two second driving protrusions that are formed on said inner surface of said surrounding wall for respectively driving said driven sections of said first and second sleeve pawls so as to switch the states of said first and second sleeve pawls, said first driving protrusions and said second driving protrusions being angularly spaced apart from each other about the axis;

an outer casing formed with a substantially polygonal hole for retaining co-rotatably said support frames therein; and a head unit connected to and driven by said shaft member.

2. The speed-selectable hand tool as claimed in claim 1, wherein said cage member further has an installation hole that is formed in said front portion of said cage section and that extends in the radial direction of the axis, said knob further having three positioning grooves that are formed in said inner surface of said surrounding wall and that are located between said first driving protrusions, said speed-selectable hand tool further comprising a positioning unit that includes a resilient member retained in said installation hole, and a positioning ball member biased resiliently by said resilient member to engage an alternative one of said positioning grooves.

3. The speed-selectable hand tool as claimed in claim 2, wherein said positioning unit further includes four pawl springs each being disposed between an inner surface of said intermediate portion of said cage member and a respective one of said first and second shaft pawls and said first and second sleeve pawls for retaining the corresponding one of said first and second shaft pawls and said first and second sleeve pawls in the enabled state.

4. The speed-selectable hand tool as claimed in claim 1, wherein said cage member further has a limiting block that projects outwardly from an outer surface of said intermediate portion, and that is retained within a limiting space of said knob defined between two adjacent ones of said first and second driving protrusions for limiting the range of relative rotational movement between said cage member and said knob.

5. The speed-selectable hand tool as claimed in claim 1, wherein said outer casing includes interconnected front and rear casing parts, said front casing part being formed with said polygonal hole and three insertion holes, said polygonal hole and said insertion holes opening toward said rear casing part, said rear casing part being mounted rotatably around said sleeve member, being located at one side of said knob opposite to said handle, and having three insertion rods that are respectively inserted into said insertion holes.

6. The speed-selectable hand tool as claimed in claim 5, wherein said knob further has an annular wall that extends from said base wall away from said surrounding wall, said rear casing part of said outer casing further having an annular groove that opens toward said knob for retaining said annular wall of said knob therein.

7. The speed-selectable hand tool as claimed in claim 1, wherein said pawl unit further includes an abrasion-resistant plate that is retained in said retaining space and that has a ring section surrounding said shaft member, and four position arms extending from said ring section.

8. The speed-selectable hand tool as claimed in claim 1, wherein said second gear section of said sleeve member and said large gear section of each of said transmission members have the same number of teeth, said first gear section of said shaft member and said small gear section of each of said transmission members having the same number of teeth, the number of teeth of said large gear section of each of said transmission members being two times that of said small gear section said transmission member.

* * * * *